US006354216B1

(12) United States Patent
Yoshida

(10) Patent No.: US 6,354,216 B1
(45) Date of Patent: Mar. 12, 2002

(54) DRIVING MECHANISM FOR SCANNING HEAD AND IMAGE RECORDING DEVICE

(75) Inventor: Futoshi Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/456,486

(22) Filed: Dec. 7, 1999

(30) Foreign Application Priority Data

Dec. 8, 1998 (JP) ..... 10-348266
Dec. 9, 1998 (JP) ..... 10-349885

(51) Int. Cl.[7] ..... B41F 1/16; B41J 23/00
(52) U.S. Cl. ..... 101/492; 347/37; 400/279
(58) Field of Search ..... 101/492; 400/76, 400/61, 70, 322, 279, 903, 315, 705; 358/410, 264, 417, 298; 318/696; 347/37

(56) References Cited

U.S. PATENT DOCUMENTS 4,586,808 A * 5/1986 Tanimoto et al. ..... 318/696
4,651,222 A * 3/1987 Gokita ..... 358/264
4,992,888 A * 2/1991 Nagashima ..... 358/410
5,008,607 A * 4/1991 Ono et al. ..... 318/696
5,198,909 A * 3/1993 Ogiwara et al. ..... 358/412
5,871,291 A * 2/1999 Kawazoe ..... 400/279
6,144,184 A * 11/2000 Yamaguchi ..... 318/696
6,152,626 A * 11/2000 Yanagi et al. ..... 400/279
6,158,905 A * 12/2000 Endo ..... 400/76
6,231,158 B1 * 5/2001 Hiyane et al. ..... 347/37

* cited by examiner

*Primary Examiner*—Eugene Eickholt
(74) *Attorney, Agent, or Firm*—Sughrue Mion, PLLC

(57) ABSTRACT

A drive control mechanism for a scanning head which travels along a scan surface and carries out image reading or image writing. The drive control mechanism includes a driving starting position changing device which changes a driving starting position of the scanning head either outside an image reading range or outside an image writing range, under a predetermined condition. Accordingly, phases of vibration periods are shifted and unevenness in density is less visible.

11 Claims, 15 Drawing Sheets

DRIVING MECHANISM FOR SCANNING HEAD AND IMAGE RECORDING DEVICE

BACKGROUND OF THE INVENTION

1. Field of the Invention

The present invention relates to a driving mechanism for a scanning head which travels along a scanning surface and reads an image or writes an image, and to an image recording device which includes such a scanning head.

2. Description of the Related Art

In recent years, there have been developed a number of image recording devices equipped with an image scanning device of a digital exposure system. As an example, as is shown in FIG. 14, there is provided an image scanning device which has a scanning head 28 which moves parallel to a rotational axis 12 of an exposure drum 14 to scan and expose an exposure surface.

This scanning head 28 slides along shafts 16 and 18 (main scanning), writes an image on a photosensitive material which is wound around the exposure drum 14 by using a light beam modulated in accordance with image data and outputted from an optical semiconductor 36 (for example, a laser diode, an LED, or the like), and then the exposure drum 14 is rotated so as to be moved in steps (sub-scanning). The above-described movements are repeated in a sequential order.

The scanning head 28 is structured such that driving force is transmitted thereto from a timing belt 46 trained around sprockets 118 and 120 which are rotated by a stepping motor 52, so that the scanning head 28 slides along the shafts 16 and 18. However, due to deviation of a rotational shaft of the stepping motor 52 or other mechanical factors of the driving mechanism (the sprockets, a timing belt, or a reduction gear), cyclic speed variations of the scanning head 28 are caused (that is, the speed varies at the same position).

Due to such variations of the scanning speed of the scanning head 28 as described above, as in waveforms L1 and L2 which are shown in FIG. 12A, vibrations, which have amplitudes and periods whose phases correspond to each other, are caused in each of a forward scanning and a reverse scanning of the scanning head 28 within an exposure range thereof.

In this state, if the scanning head 28 writes an image, due to density variations (density unevenness) which are generated in a direction intersecting a scanning direction of the scanning head 28 (i.e., which are generated in the sub-scanning direction), vertical stripes are formed at fixed positions (for example, position C in FIG. 12A), thus deteriorating image quality noticeably.

Moreover, as shown in FIG. 15, the scanning head 28 starts being driven from a stopping position S which is located outside a writing range, is accelerated and thereafter attains a constant speed in the writing range. Then, outside of the writing range, the speed of the scanning head is reduced, and the scanning head stops at a stopping position E. However, when driving is started, vibration is generated in the scanning head 28.

Since the vibration phases correspond to each other per scan in the forward or reverse direction, if writing of an image is carried out in such a state, vertical stripes due to density variations are generated in the scan direction and the direction orthogonal thereto, deteriorating the image quality considerably.

For example, if the frequency of the vibration is 50 HZ and the scanning speed of the scanning head 28 is 600 mm/s, vertical stripes are generated at a 12 mm pitch.

SUMMARY OF THE INVENTION

In view of the aforementioned, an object of the present invention is to shift vibration periods or phases of a scanning head so as to reduce visibility of vertical stripes caused by variations in density.

In a first aspect of the present invention, there is provided a scanning head which travels along a scan surface and reads or writes an image. For each scan in which the scanning head travels and reads or writes an image, at least one of the period of and phase of the vibration generated at the scanning system is shifted. In this way, the visibility of vertical stripes caused by fluctuations in density can be reduced.

In a second aspect of the invention, the driving control mechanism changes a driving starting position of the scanning head or an acceleration starting position of the scanning head, either outside of the image reading range or outside of the image writing range.

In the aforementioned structure, not by shifting the driving starting positions randomly (it is of course allowable to shift the driving starting positions randomly), but by shifting the driving starting position per scan in case of reciprocating scans and by shifting the driving starting position per even-numbered scan in the case of one-way scans, it is ensured that the phases of the vibration of the scanning head can be shifted and visibility of vertical stripes can be reduced.

In a third aspect of the present invention, the driving mechanism for a scanning head of the first aspect further comprises: an acceleration pattern which generates vibrations at the scanning head at an arbitrary position during acceleration of the scanning head, in each scan for one of reading an image and writing an image; and a mechanism for changing the acceleration pattern, which changes the position at which vibrations are generated.

In this way, sudden changes in acceleration are applied to the scanning head during acceleration at a different position for each scan. Thus, the phase of the vibration is different for each scan, and vertical stripes are therefore less visible.

In a fourth aspect, the driving starting position or acceleration starting position is input in advance, on the basis of data on vibration periods when the scanning head is driven. The data on vibration periods may be measured and input in a memory for every machine type prior to shipping. Also, data input means may be provided in an image recording device, and, by using a test chart, positions where vertical stripes are produced may be actually identified visually, and the driving starting position or acceleration starting position may be shifted per scan. In this way, the driving mechanism for a scanning head of the present invention can cope with variations in the vibration periods that occur as time passes.

In a fifth aspect, data on vibration periods during driving of the scanning head is measured, and on the basis of the measured data, the one of the driving starting position and the acceleration starting position of the scanning head is calculated, and the calculated one of the driving starting position and the acceleration starting position of the scanning head is inputted. As the measuring means, for example, a linear encoder may be attached to the scanning head, or a rotary encoder may be attached to a rotational shaft of a sprocket which transmits driving force to the scanning head, to measure the data.

As described above, by measuring data per scan and calculating the driving starting position or the acceleration starting position, the driving mechanism for a scanning head of the present invention can cope with variations in vibration periods that occur due to disturbances.

In a sixth aspect, the drive control mechanism changes the stopping position of the scanning head, and, from the stopping position, driving of the scanning head is started.

In the aforementioned structure, if the stopping position of the scanning head is controlled and the scanning head is driven from the stopping position, the driving starting position or acceleration starting position can of course be shifted. Therefore, compared with a controlling method in which the stopping position is fixed and the driving starting positions are shifted when driving is started, control can be simplified.

In a seventh aspect of the present invention, for each scan in which an image is read or written, the phase of the vibration period is varied between the forward direction and the reverse direction by superposing fine driving on the driving pulse of the pulse motor which drives the scanning head.

An eighth aspect of the present invention is a driving mechanism for a scanning head which moves reciprocatingly so as to one of read and write an image, comprising: a driving force transmitting mechanism which has a mechanism that creates a difference between at least one of phases of and periods of vibration caused by a scanning and driving system, in a forward scanning and a backward scanning of the scanning head.

Thus, since a difference is provided between periods of vibration in each scan, there is no concentration of density unevenness and the visibility of vertical stripes is reduced so that image quality can be improved.

In a ninth aspect of the present invention, the driving force transmitting mechanism comprises: sprockets which are provided at both sides of a guide which guides travel of the scanning head; a timing belt which is trained around the sprockets and a portion of which is fixed to the scanning head; a driving shaft which transmits rotational force from a driving source to the sprockets; and a sprocket play mechanism which is provided between the sprockets and the driving shaft, and which, when a rotating direction of the driving shaft changes, causes the driving shaft to rotate idly by a predetermined amount.

In this structure, the scanning head can travel along the guide. Sprockets are provided at both sides of the guide, and a portion of the timing belt, which is trained around the sprockets, is fixed to the scanning head.

When the rotational direction of the driving shaft is changed in order to change the direction of movement of the scanning head from forward to backward, the driving shaft rotates idly by a predetermined amount due to the sprocket play mechanism, and rotational force is thereby transmitted from a driving source to the sprockets.

Since the phases of the periods of vibration of the scanning and driving system differ in the forward scanning and the backward scanning by amount corresponding to the amount of idle rotation, there is no concentration of density unevenness, and thus, the visibility of vertical stripes can be reduced. Providing play at the sprockets is particularly effective when there are causes for deviation in the rotation of the sprockets.

In a tenth aspect of the present invention, the driving force transmitting mechanism comprises: sprockets which are provided at both sides of a guide which guides travel of the scanning head; a driving shaft which transmits rotational force from a driving source to the sprockets; a timing belt which is trained around the sprockets; and a timing belt play mechanism which is provided between the timing belt and the scanning head, and which transmits moving force of the timing belt to the scanning head, and which, when the moving direction of the timing belt changes, causes the timing belt to move idly by a predetermined amount.

In this tenth aspect of the present invention, when the moving direction of the timing belt changes, the timing belt moves idly by a predetermined amount due to the timing belt play mechanism, and moving force is transmitted to the scanning head.

Since the phases of the periods of vibration of the scanning and driving system differ in the forward scanning and the backward scanning by amount corresponding to the amount of idle rotation, there is no concentration of density unevenness, and thus a reduction in the visibility of vertical stripes is possible. Providing play at the points at which the driving force is transmitted to the scanning head is particularly effectively when there are causes for deviation at the driving source (e.g., deviation of the rotational shaft of the stepping motor).

In an eleventh aspect of the present invention, due to the switching mechanism changing the tension of the timing belt for the forward direction scans and reverse direction scans of the scanning head, the phase of the vibration period of the scanning driving system differs between the forward direction and the reverse direction. Therefore, unevenness in density is not concentrated, and visibility of vertical stripes decreases.

DESCRIPTION OF THE PREFERRED EMBODIMENTS

Figure 1:
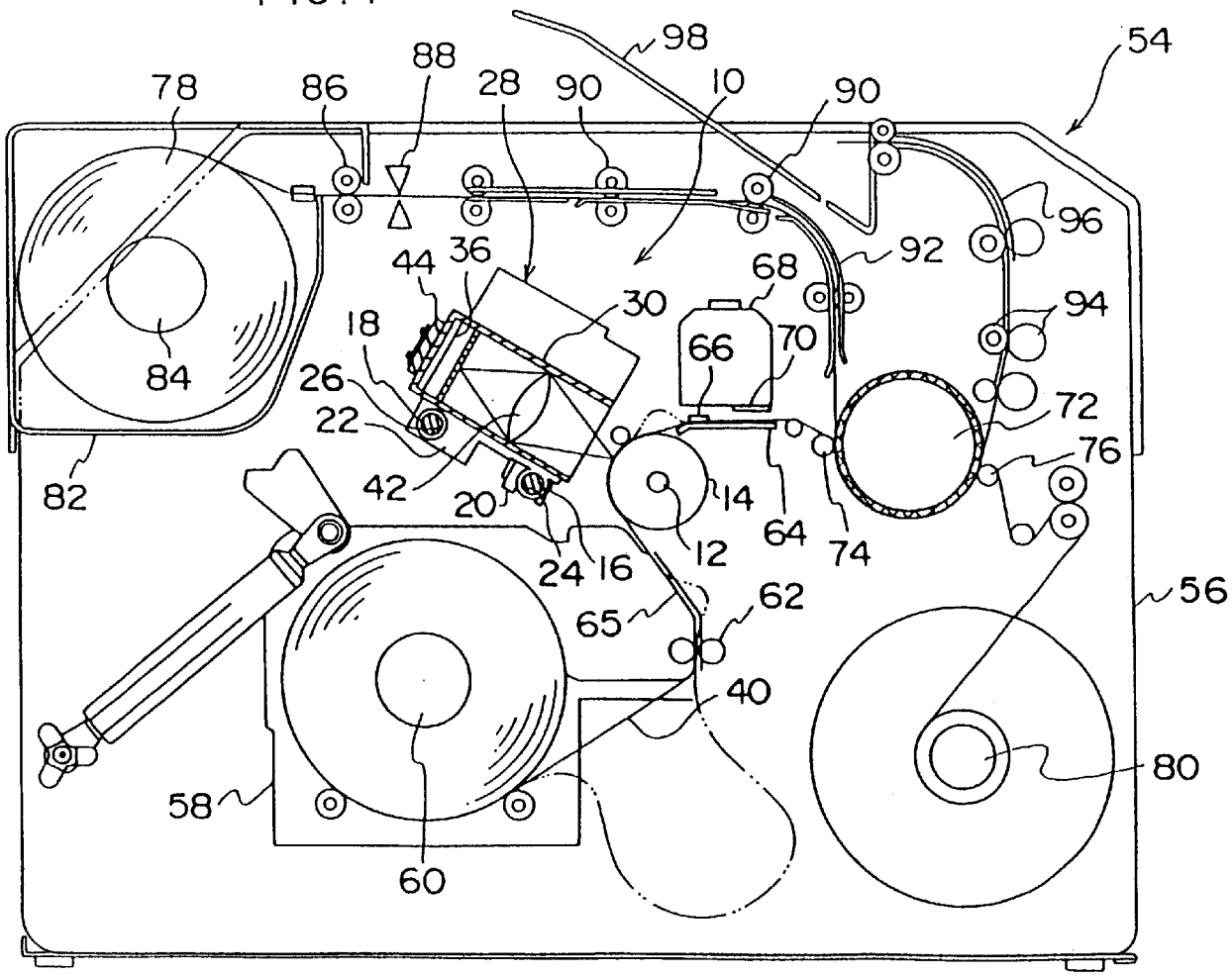
FIG. 1 is a schematic view of an image recording device in which a driving mechanism for a scanning head according to a first embodiment of the present invention is provided.
Figure 2:
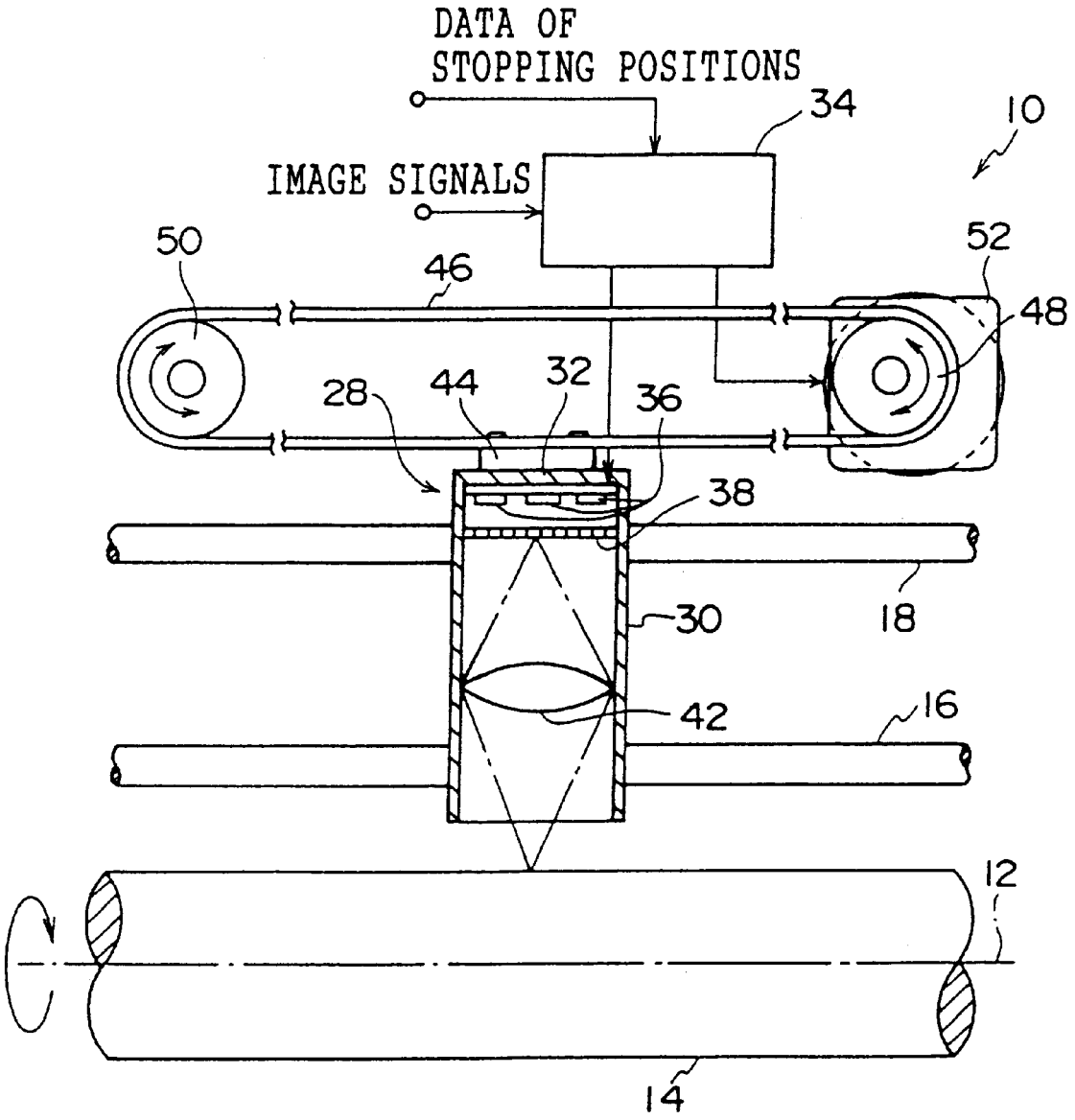
FIG. 2 is a front view which shows the driving mechanism for a scanning head according to the first embodiment of the present invention.

FIGS. 1 and 2 illustrate an exposing section 10 in which a driving mechanism for a scanning head relating to a first embodiment of the present invention is provided.

At the exposing section 10, both end portions of an exposure drum 14 are supported by a rotatable rotational shaft 12. The exposure drum 14 has a cylindrical shape, and an exposing surface thereof has a constant curvature around the rotational shaft 12.

Further, diagonally upwards to the left of the exposure drum 14 in FIG. 1, two shafts 16 and 18 are disposed in parallel with the rotational shaft 12. The shafts 16 and 18 are inserted into supporting holes 24 and 26 which are respectively formed in supporting blocks 20 and 22 so as to pass therethrough. The supporting blocks 20 and 22 can be slid along the shafts 16 and 18, respectively. Further, the supporting blocks 20, which are two in number, are provided towards the exposure drum 14, and the supporting block 22 is provided at another side. Therefore, a flat surface is formed by the three supporting blocks.

A casing 30 of a scanning head 28 is fixed to the supporting blocks 20 and 22. At the inner side of a bottom plate 32 of the casing 30 are disposed three LED chips 36 of R (red), G (green), and B (blue) which are lit in accordance with signals from a controlling section 34 in which image signals are stored. The light emission surfaces of the LED chips 36 face towards the inner side of the casing 30.

The three LED chips 36 are arranged along a main scanning direction of the scanning head 28, and each LED chip 36 has thirty-one (31) elements along a sub-scanning direction. A slit plate 38 is provided at a light emitting side of the LED chips 36 so as to limit diffusion of light.

An image forming lens 42 is disposed inside the casing 30. This image forming lens 42 is structured by a plurality of lenses and diaphragms, condenses light from the LED chips 36, and forms an image on a photosensitive material 40 wound around the exposure drum 14. In addition, focussing is adjusted automatically by unillustrated auto-focus mechanism.

On the other hand, on an outer surface of the bottom plate 32, a linkage plate 44 is mounted. Onto the linkage plate 44, an endless timing belt 46 is fixed. The timing belt 46 is trained around sprockets 48 and 50 provided in the vicinities of the ends of the shafts 16 and 18. Rotating force of a stepping motor 52 is transmitted to the sprocket 48 via a speed reducer, so that the scanning head 28 moves along the shafts 16 and 18 reciprocatingly.

The driving of the stepping motor 52 is controlled by the controlling section 34 and is synchronized with the step driving of the photosensitive material 40. Namely, in a state in which the photosensitive material 40 is stopped after its step movement, the stepping motor 52 is rotated in the forward direction and the scanning head 28 is moved along the shafts 16 and 18 in the transverse direction of the photosensitive material 40 (the main scanning direction).

Moreover, after a predetermined number of pulses has been confirmed, and in a state in which the photosensitive material 40 is step-moved and is then stopped, by rotating the stepping motor 52 in the reverse direction, main scanning in both forward and reverse directions is carried out.

Next, a schematic structure of an image recording device 54 will be described.

As illustrated in FIG. 1, in a photosensitive material magazine 58 disposed at a lower side of a housing 56 of the image recording device 54, a photosensitive material 40 wound about a supply reel 60 is set. The supply reel 60 is rotated by unillustrated driving means so as to roll the photosensitive material 40 out.

A leading portion of the photosensitive material 40 is nipped by pulling rollers 62 provided at a discharge opening of the photosensitive material magazine 58. The pulling rollers 62 pull out the photosensitive material 40 under predetermined conditions and convey the photosensitive material 40 to a guide plate 64, or alternatively, the rollers 62 form a buffer (represented by a double-dashed chain line in FIG. 1) under predetermined conditions.

The photosensitive material 40, after passing the guide plate 65, is trained about the exposure drum 14, and is exposed imagewise by the scanning head 28. In this way, by training the photosensitive material 40 around the exposure drum 14 and exposing the photosensitive material 40, wrinkles and the like are not formed in the transverse direction of the photosensitive material 40 and the flatness of the exposure surface can be ensured.

The photosensitive material 40 onto which an image was exposed is nipped between a supporting stand 64 and a pressure plate 66, and water is applied to the photosensitive material 40 by an applying member 70 (a sponge or the like) which is water-absorptive and is provided at an application tank 68.

The photosensitive material 40 onto which water has been applied is trained at a fixed pressure by tension rollers 74, 76 around a heating drum 72 having a halogen lamp built therein. The photosensitive material 40 which is trained around the heating drum 72 is superposed with an image receiving paper 78 to be described later from an upper surface thereof while being heated, and an image is transferred.

The photosensitive material 40 whose image has been transferred onto the image receiving material (the image receiving paper 78) is taken-up onto a disposal reel 80. By transferring the photosensitive material 40 from the supply reel 60 to the disposal reel 80 without cutting the photosensitive material 40 into pieces, the photosensitive material 40 itself serves as a timing belt for imparting a predetermined pressure to the image receiving paper 78.

The image receiving paper 78, which is rolled around a supply reel 84, is set in an image receiving paper accommodating magazine 82 which is disposed at an upper side of the interior of the housing 56. The image receiving paper 78 is pulled out by nip rollers 86 and cut to a predetermined length by a cutter 88. Thereafter, the image receiving paper 78 is guided by conveying rollers 90 and guiding plates 92 and then wound around the heat drum 72 while being overlapped with the photosensitive material 40.

The image receiving paper 78, onto which image has been transferred from the photosensitive material 40, is peeled off from the heat drum 72 by an unillustrated peeling claw. Then, the image receiving paper 78 is guided by conveying rollers 94 and guiding plates 96, and reaches a tray 98.

Figure 3:
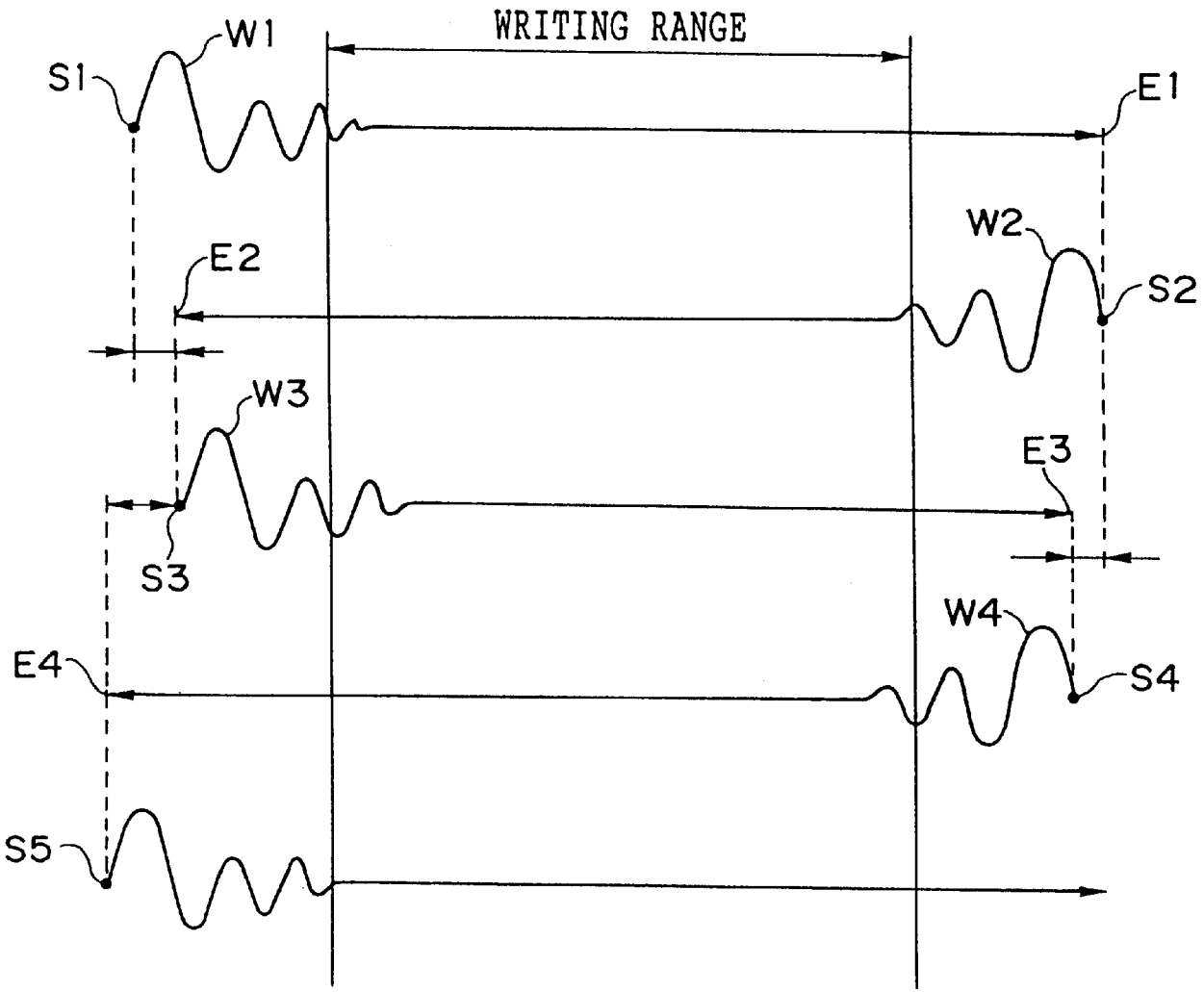
FIG. 3 is a graph which shows vibration waveforms when the scanning head according to the first embodiment of the present invention scans reciprocatingly.

The driving mechanism for a scanning head will be described with reference to vibration waveforms at the time the scanning head 28 is accelerated, which vibration waveforms are shown in FIG. 3 as an example.

In a first scan, which is in the forward direction, the position where driving of the scanning head 28 starts is S1, and, during the time the scanning head 28 is accelerated until it reaches a writing range in which it moves at a constant speed, vibration such as W1 is generated. Though the vibration is attenuated, at the starting point of the writing range, vertical stripes caused, in particular, by variations in density, are generated.

Here, the scanning head 28 is stopped at position E1 as it completes the first scan, which is in the forward direction. At this time, the number of pulses which were output from the controlling section 34 to the stepping motor 52 is P.

Moreover, in a second scan of the scanning head 28, which is in the reverse direction, the position E1 becomes driving starting position S2, and here, also, during the time the scanning head 28 is accelerated until it reaches the writing range in which it travels at a constant speed, vibration W2 is generated, and vertical stripes caused by variations in density are generated.

Here, the scanning head 28 is stopped at position E2 when it completes the second scan, in the reverse direction. At this time, the number of pulses which were output from the controlling section 34 to the stepping motor 52 is $P-\alpha$, and the scanning head 28 is stopped at a position that differs from the driving starting position S1.

Therefore, in a third scan of the scanning head 28, which is in the forward direction, driving starting position S3 differs from the first driving starting position S1 so that the phase of vibration W3 is shifted from that of the vibration W1 and the vertical stripes do not continue in the sub-scanning direction. Accordingly, the visibility of the vertical stripes is lowered.

Then, the scanning head 28 is stopped at position E3 when it completes the third scan, in the forward direction. At this time, the number of pulses which were output from the controlling section 34 to the stepping motor 52 is $P-2\alpha$, and the scanning head 28 is stopped at a position that differs from the driving starting position S2.

Therefore, in a fourth scan of the scanning head 28, which is in the reverse direction, the driving starting position 54 differs from the second driving starting position S2 so that the phase of vibration W4 is shifted from that of the vibration W2 and the vertical stripes do not continue in the sub-scanning direction. Accordingly, visibility of the vertical stripes is lowered.

Then, the scanning head 28 is stopped at position E4 when it completes the fourth scan, which is in the reverse direction. At this time, the number of pulses which were output from the controlling section 34 to the stepping motor 52 is P, and the scanning head 28 is stopped at a position that differs from the driving starting position S3. In a fifth scan of the scanning head 28, which is in the forward direction, a driving starting position S5 differs from the third driving starting position S3.

In this way, by controlling the pulses of the stepping motor 52 to sequentially shift the driving starting positions of the scanning head 28, the visibility of the vertical stripes is lowered and the image quality is improved.

Figure 4:
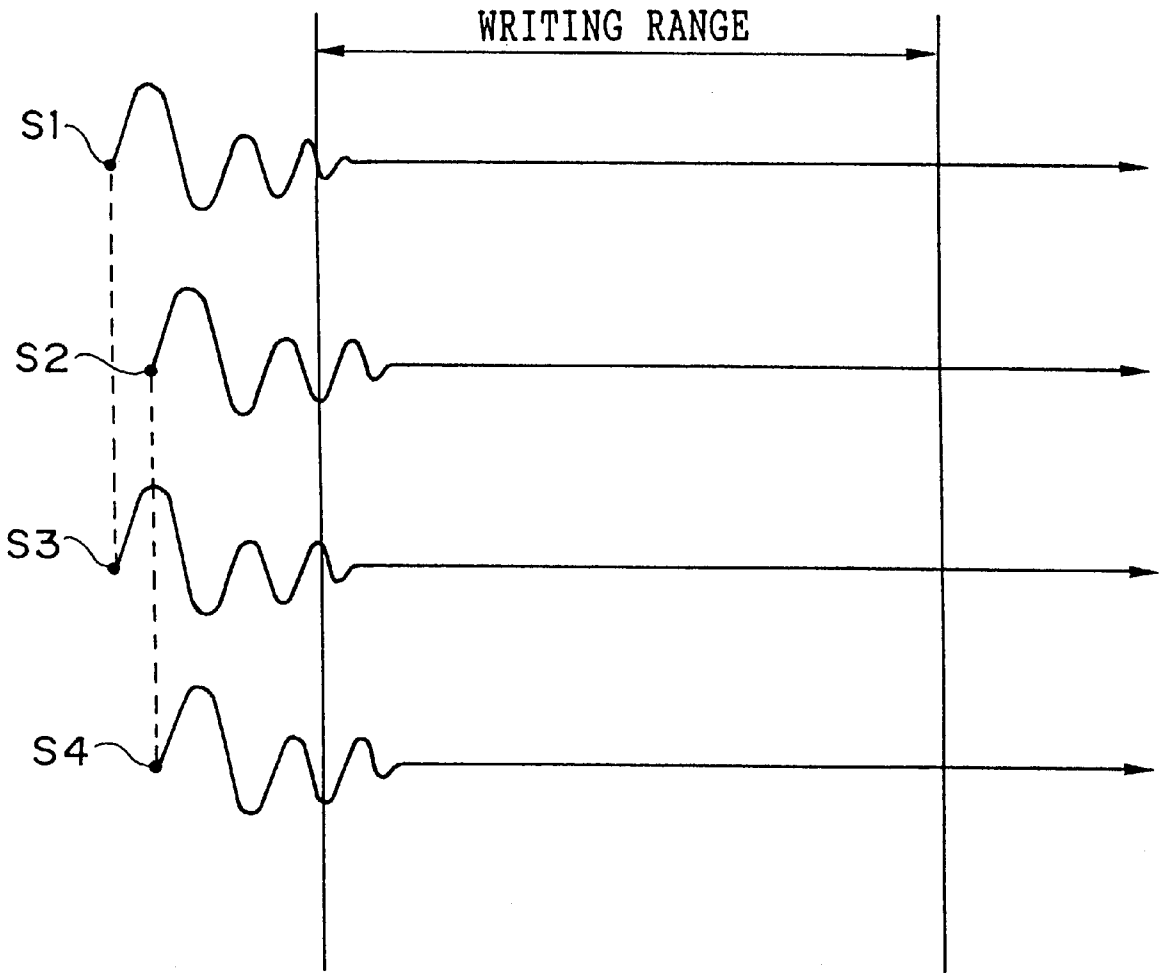
FIG. 4 is a graph which shows vibration waveforms when the scanning head according to the first embodiment of the present invention scans in one direction.

By changing the number of pulses, the driving starting positions of the scanning head 28 are shifted. However, as shown in FIG. 4, in a case in which the scanning head 28 scans in one direction, by shifting the driving starting positions S1, S2, S3, and S4 every even-numbered scan, the visibility of the vertical stripes due to density variations can be reduced.

Moreover, in order to shift the scan-line vibration phases of the scanning head 28 (the vibration phases are shifted within a range of from one-fourth of a phase to three-fourth of a phase), ways to shift the driving starting positions may be altered randomly regardless of the aforementioned rules.

Further, a control method in which the stopping position of the scanning head 28 per scan is constant, the driving position is shifted before starting driving, and the scanning head 28 is again accelerated thereafter may be used. In other words, the driving starting position of the scanning head 28 may be shifted.

Moreover, in the present embodiment, data for the stopping positions are to be input in the controlling section 34. However, for example, pulse control, in which an image is written onto a test chart which includes marks in which timing is sequentially described, the unevenness of density is visually identified, and input means which is manually controlled is provided so as to change the driving starting positions, may be applied. In this way, the driving mechanism for a scanning head of the present invention can also cope with variations in vibration periods that occur as time passes.

Further, by attaching a linear encoder to the scanning head 28 or attaching a rotary encoder to a rotational shaft of the sprocket to measure vibration data per scan and calculate the number of pulses so as to have the vibration phases shifted, the scanning head 28 can cope with variations in vibration periods that occur due to disturbances.

The above describes a case in which the driving starting position of the scanning head is shifted. However, the phase may be shifted by shifting the accelerating starting position (which is outside of the writing range) of the scanning head.

Figure 5:
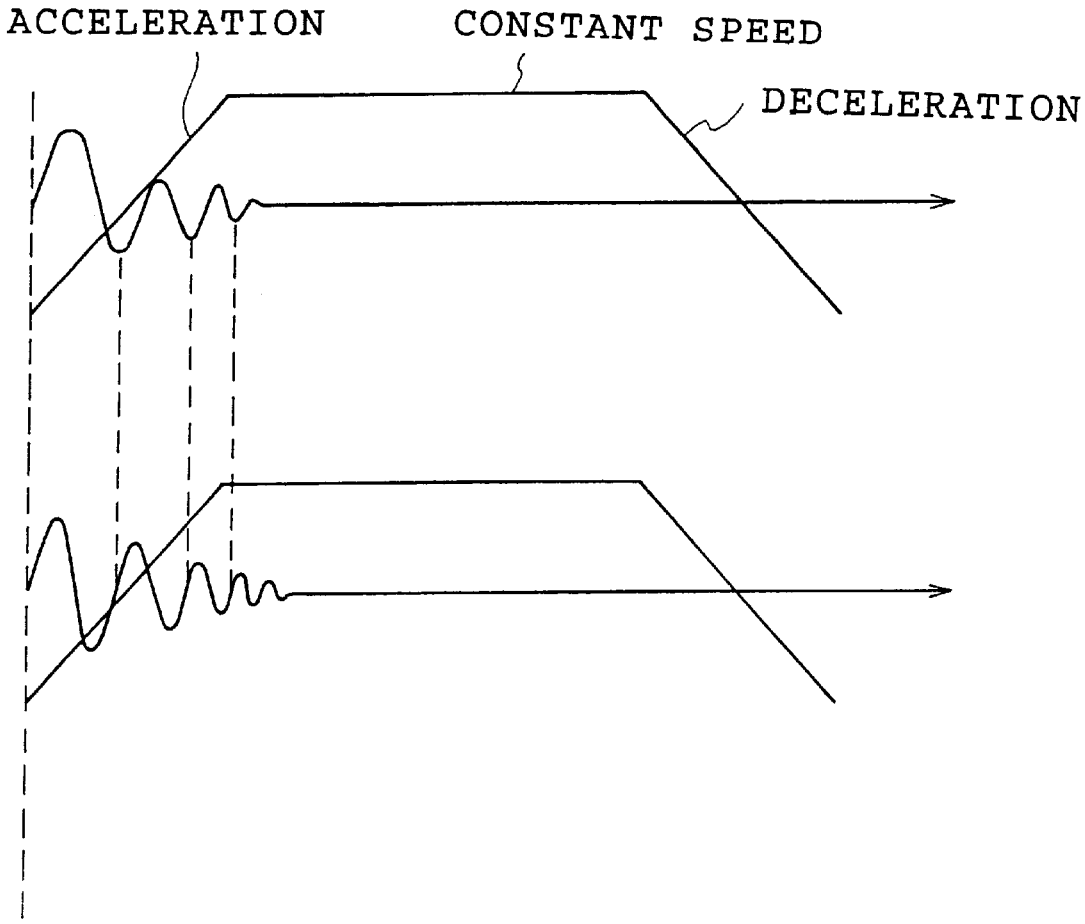
FIG. 5 is a graph which shows vibration waveforms when fine driving is superposed on a driving pulse of a pulse motor each time the scanning head scans.

As illustrated in FIG. 5, the phase of the vibration period can be made to differ between forward direction and the reverse direction by superposing fine driving on the driving pulse of the pulse motor each time the scanning head scans.

Next, a driving mechanism for a scanning head relating to a second embodiment of the present invention will be described.

Figure 6:
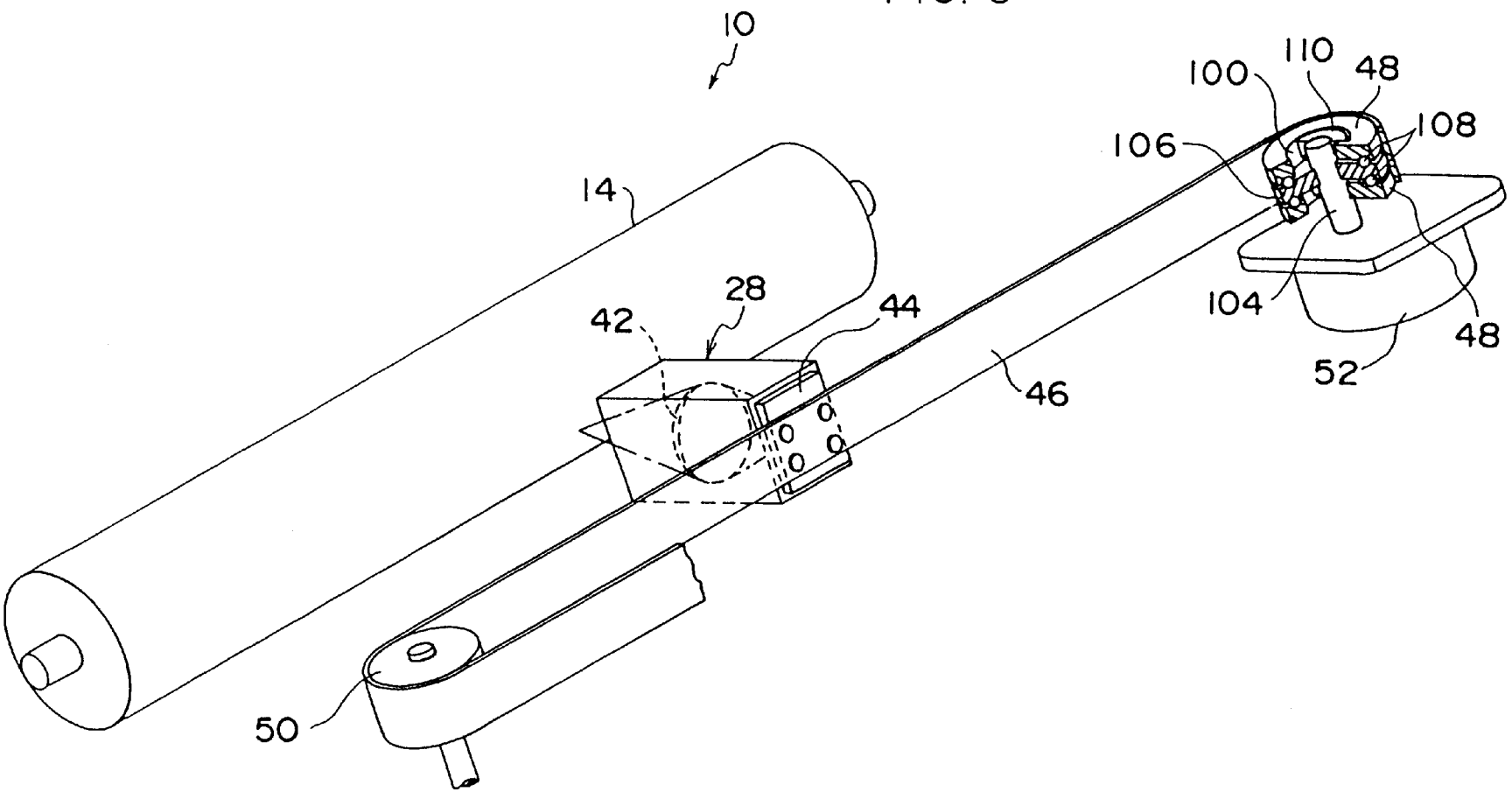
FIG. 6 is a perspective view illustrating a driving mechanism for a scanning head according to a second embodiment of the present invention.
Figure 9:
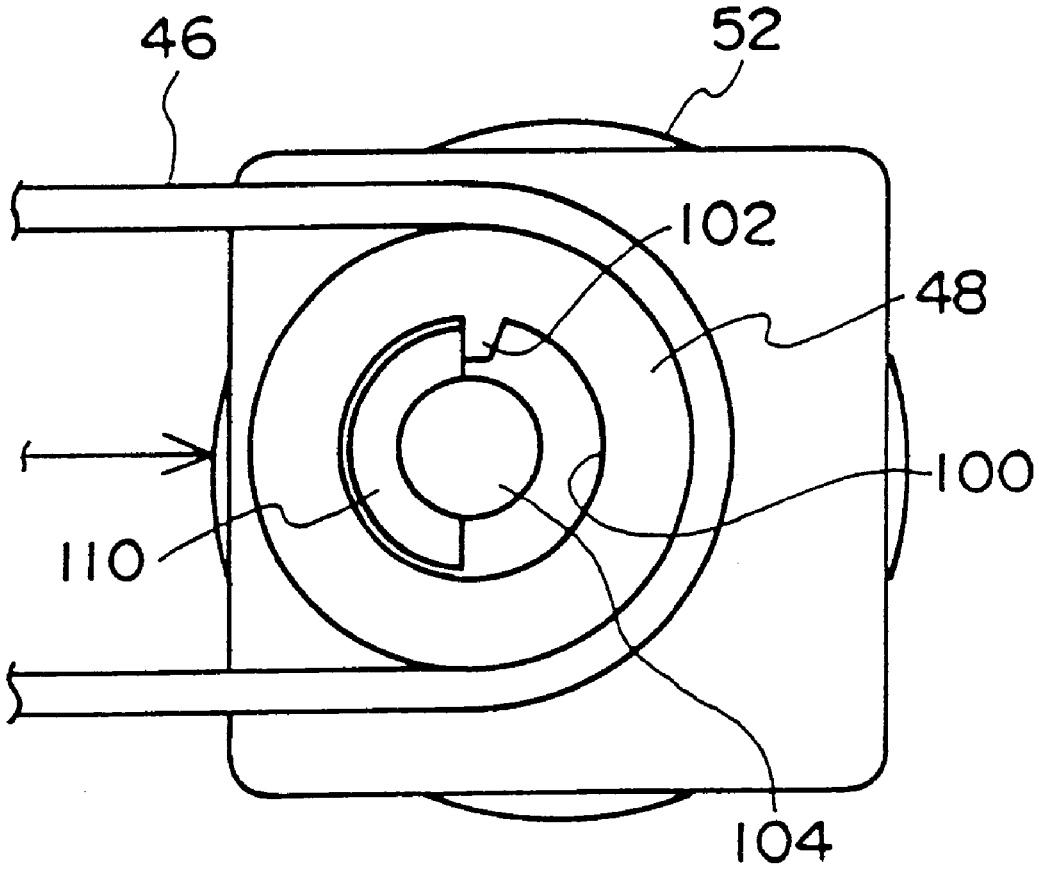
FIG. 9 is an enlarged view illustrating a play mechanism of a sprocket.

As is shown in FIGS. 6 and 9, a circular hole 100 is formed at the center of each sprocket 48. A protruding wall 102 is provided so as to protrude from an inner circumferential wall of this circular hole 100 toward a core portion. These sprockets 48 are attached to a disc plate 106 which is mounted to a driving shaft 104 of a reduction gear, through radial bearings 108, in such a way that the sprockets 48 sandwich the disc plate 106 from both sides thereof. Accordingly, the two sprockets 48 are supported by the disc plate 106 so as to be able to rotate.

A semi-circular block 110 is fixed to the driving shaft 104, and is positioned inside the circular hole 100. In accordance with forward or reverse rotation of the driving shaft 104, this block 110 rotates in an idle manner by a predetermined amount (i.e., rotates with play) until it abuts the protruding wall 102. When the block 110 is abutted against the protruding wall 102, the rotational force of a stepping motor 52 is transmitted to the sprocket 48 through the driving shaft 104 so that the scanning head 28 moves reciprocatingly along the shafts 16 and 18.

The driving of the stepping motor 52 is controlled by a controller 34 so as to be made synchronous with the step driving of the photosensitive material 40. Namely, in a state in which the photosensitive material 40 stops after its step movement, the stepping motor 52 rotates forward, and the scanning head 28 moves in a widthwise direction of the photosensitive material 40 (main scanning direction) along the shafts 16 and 18.

After a predetermined number of pulses has been recognized, in a state in which the photosensitive material 40 is step-moved and then stops, the scanning head 28 carries out main scanning in both forward and reverse directions due to the stepping motor 52 being rotated reversely.

Next, operation of the driving mechanism for a scanning head according to the second embodiment of the present invention will be described.

Figure 7:
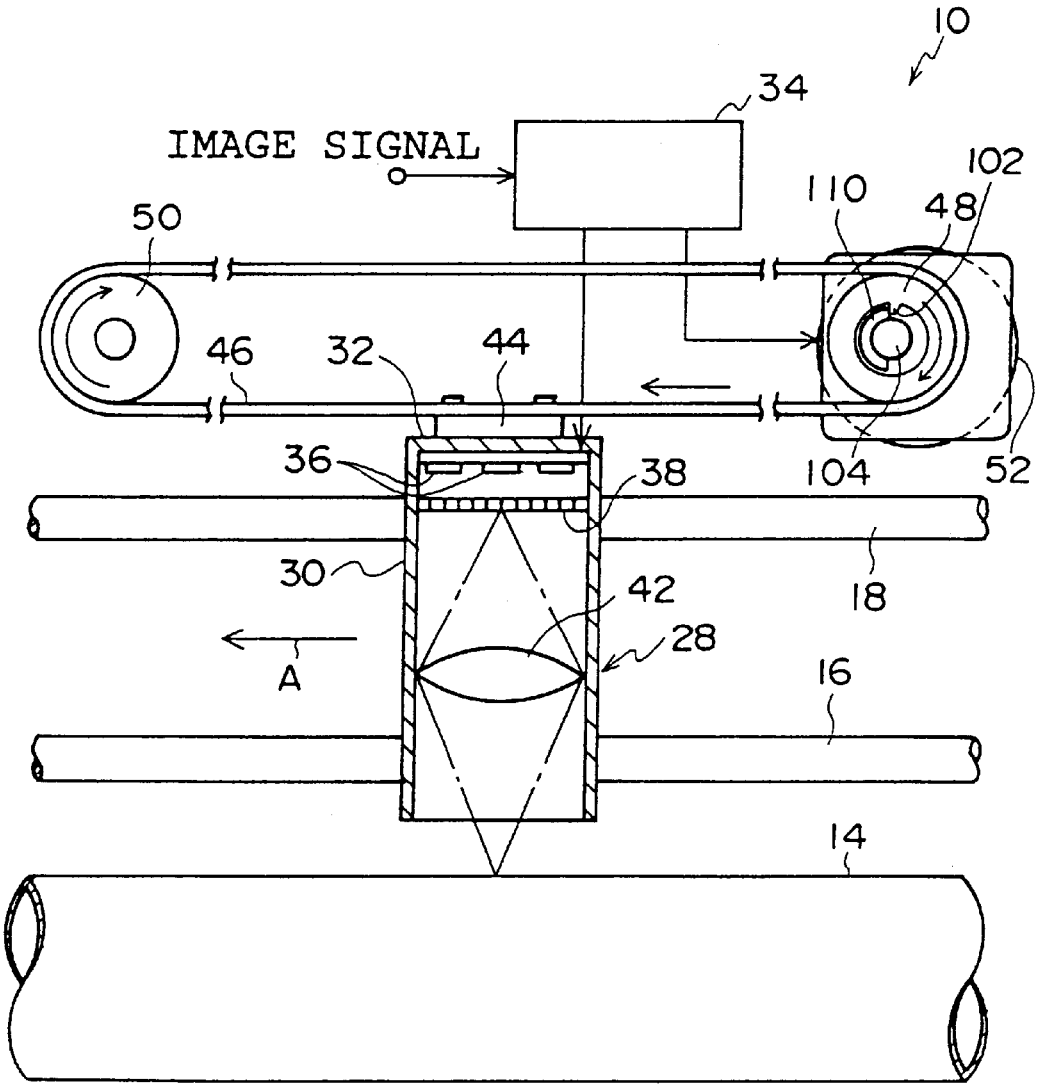
FIG. 7 is a front view illustrating a state of the driving mechanism for a scanning head according to the second embodiment of the present invention during forward scanning.

As is shown in FIG. 7, when the scanning head 28 is scanning in the direction of arrow A (i.e., forward scanning), the block 110 abuts the protruding wall 102 from a clockwise direction, thereby causing the sprockets 48 to rotate in the clockwise direction.

Figure 12A:
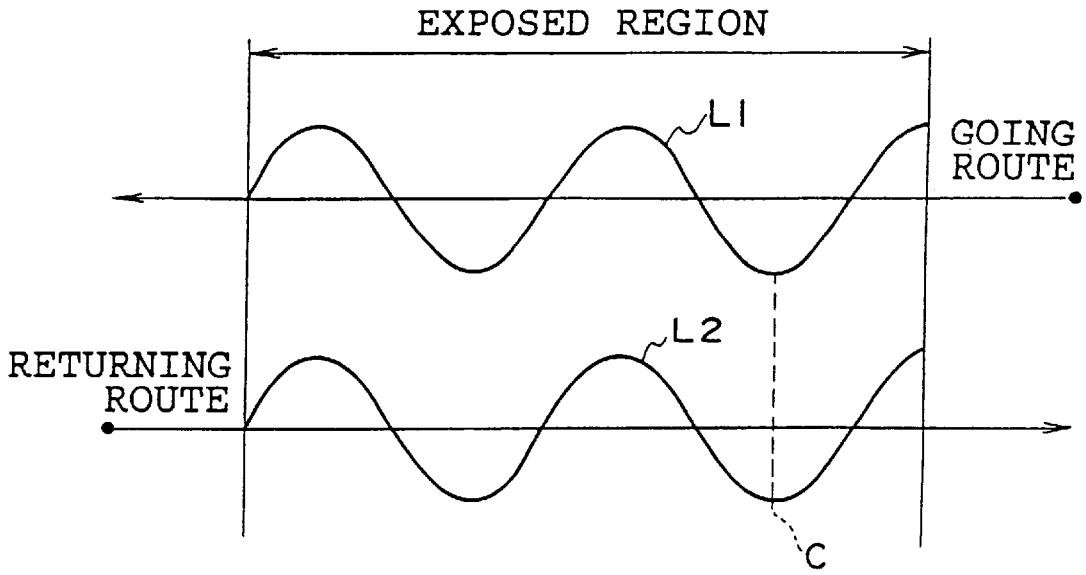
FIG. 12A is a graph illustrating phases of amplitudes and periods of vibration of a scanning head in a case in which there is no phase difference between the amplitudes and periods of the vibration in each of the forward scanning and the backward scanning.
Figure 12B:
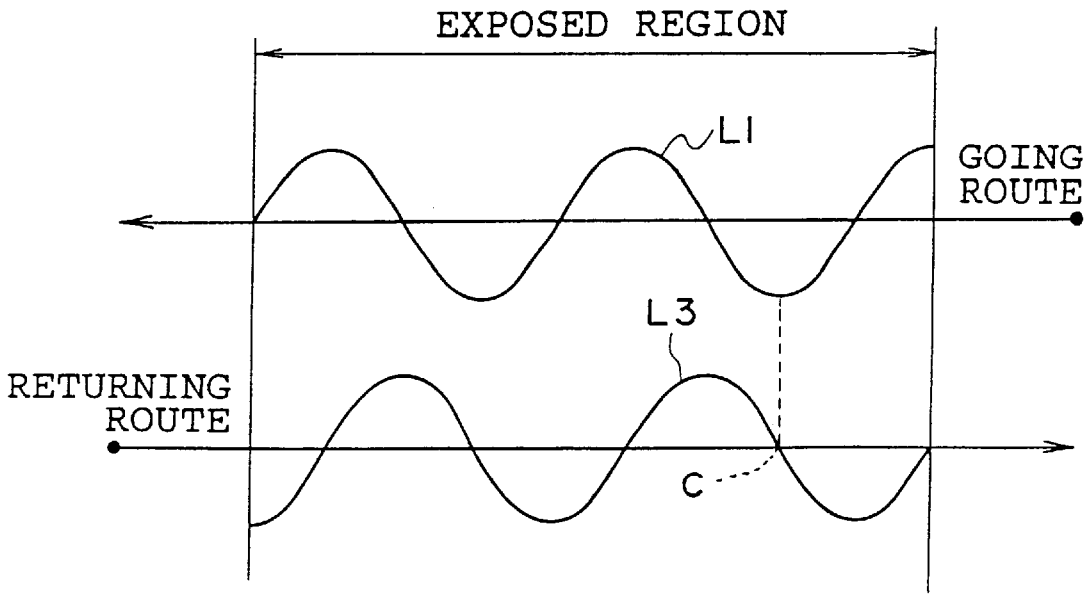
FIG. 12B is a graph illustrating phases of amplitudes and periods of vibration of a scanning head in a case in which there is a ¼ phase difference between the amplitudes and periods of the vibration in each of the forward scanning and the backward scanning.

At this time, as is shown in FIG. 12B, amplitudes and periods of vibration caused by a scanning and driving system have a waveform L1 which is particular to the scanning and driving system. Here, in the case in which there is no play between the sprockets 48 and the driving shaft 104, when the driving shaft 104 is made to rotate in a counterclockwise direction, amplitudes and periods of vibration caused by the scanning head 28 have, as is shown in FIG. 12A, a waveform L2 whose phase is the same as the waveform L1, during backward scanning (i.e., when the scanning head 28 scans in the direction of arrow B in FIG. 8).

Accordingly, when an image is written onto a photosensitive material in such a state as described above, vertical stripes due to density variations (density unevenness) are formed on the same sub-scanning line (for example, at the position C), and image quality thereby deteriorates noticeably.

Figure 8:
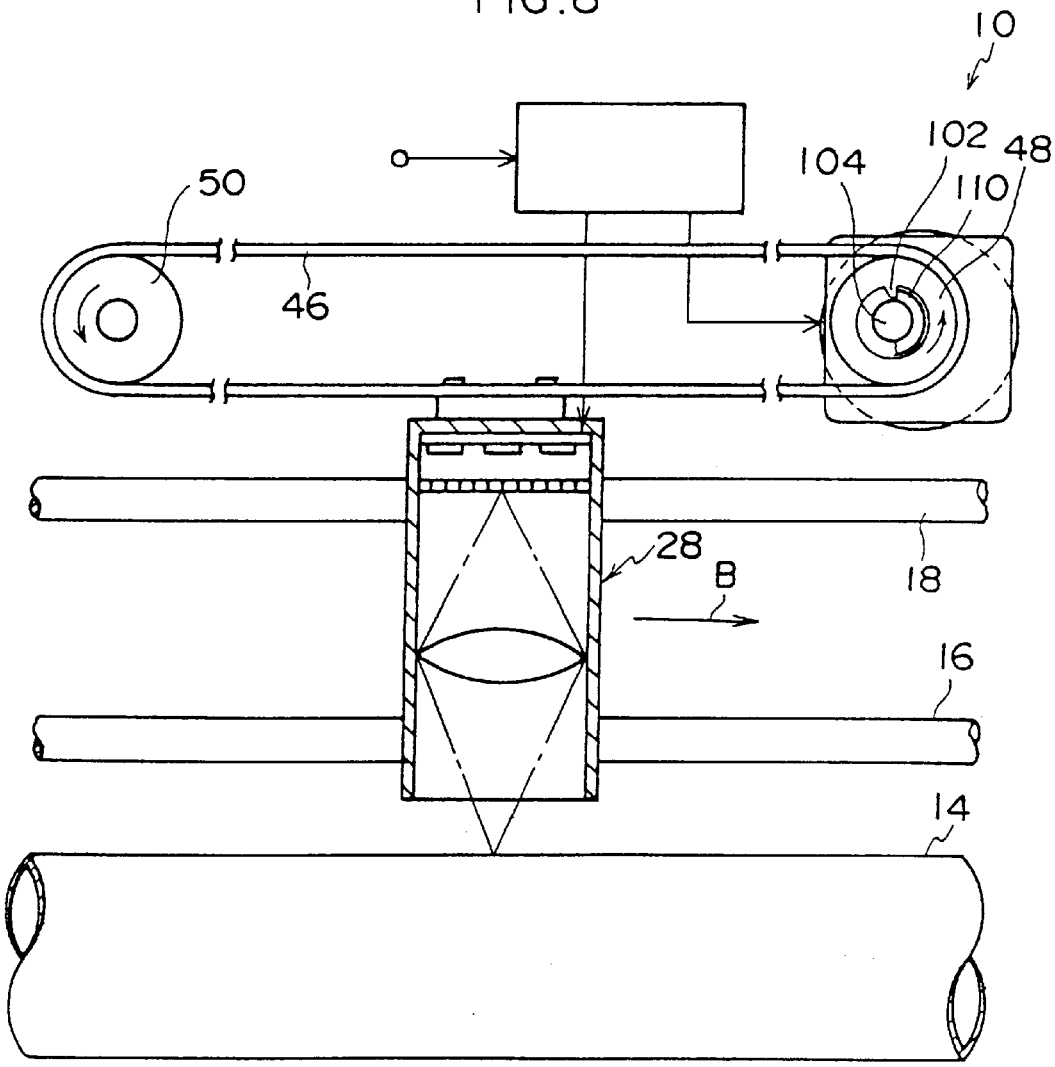
FIG. 8 is a front view illustrating a state of the driving mechanism for a scanning head according to the second embodiment of the present invention during backward scanning.

However, in the present embodiment, the block 110 rotates idly, from the state in which the scanning head 28, which has scanned in the forward direction, has stopped and the stepping motor 52 rotates reversely, to the state in which, as is shown in FIG. 8, the block 110 abuts the protruding wall 102 from a counterclockwise direction. (The amount of idle rotation of the block 110 equals a value in which a stroke of the scanning head 28 becomes ¼ of a wavelength of the waveform L1.)

As is shown in FIG. 12B, amplitudes and periods of vibration, which is caused by the scanning and driving system which scans in the reverse direction, form a waveform L3 which is out of phase by ¼ of a phase as compared to the waveform formed by those amplitudes and periods during scanning in the forward direction. For this reason, since the phases of the periods of vibration do not correspond to each other in each of the forward scanning and the backward scanning, density unevenness is prevented from concentrating at a given position, and visibility of vertical stripes thereby decreases, thus improving image quality.

In the present embodiment, the phase difference is made to be ¼. However, the present invention is not limited to this phase difference. Provided that the phase difference is within a range from ¼ to ¾, it is possible to decrease the visibility of vertical stripes. Further, providing the sprocket 48 with play is particularly effective when there are causes for deviation in a rotational system of the sprockets.

In the present embodiment, the play mechanism is provided at the sprocket 48. However, in the case in which there is deviation at the gears of the speed reducer, the period of the deviation of the gears can be determined so as to provide a play mechanism corresponding to the period of the deviation on the rotational axis of the gears of the speed reducer.

Next, a driving mechanism for a scanning head according to a third embodiment of the present invention will be explained.

Figure 10:
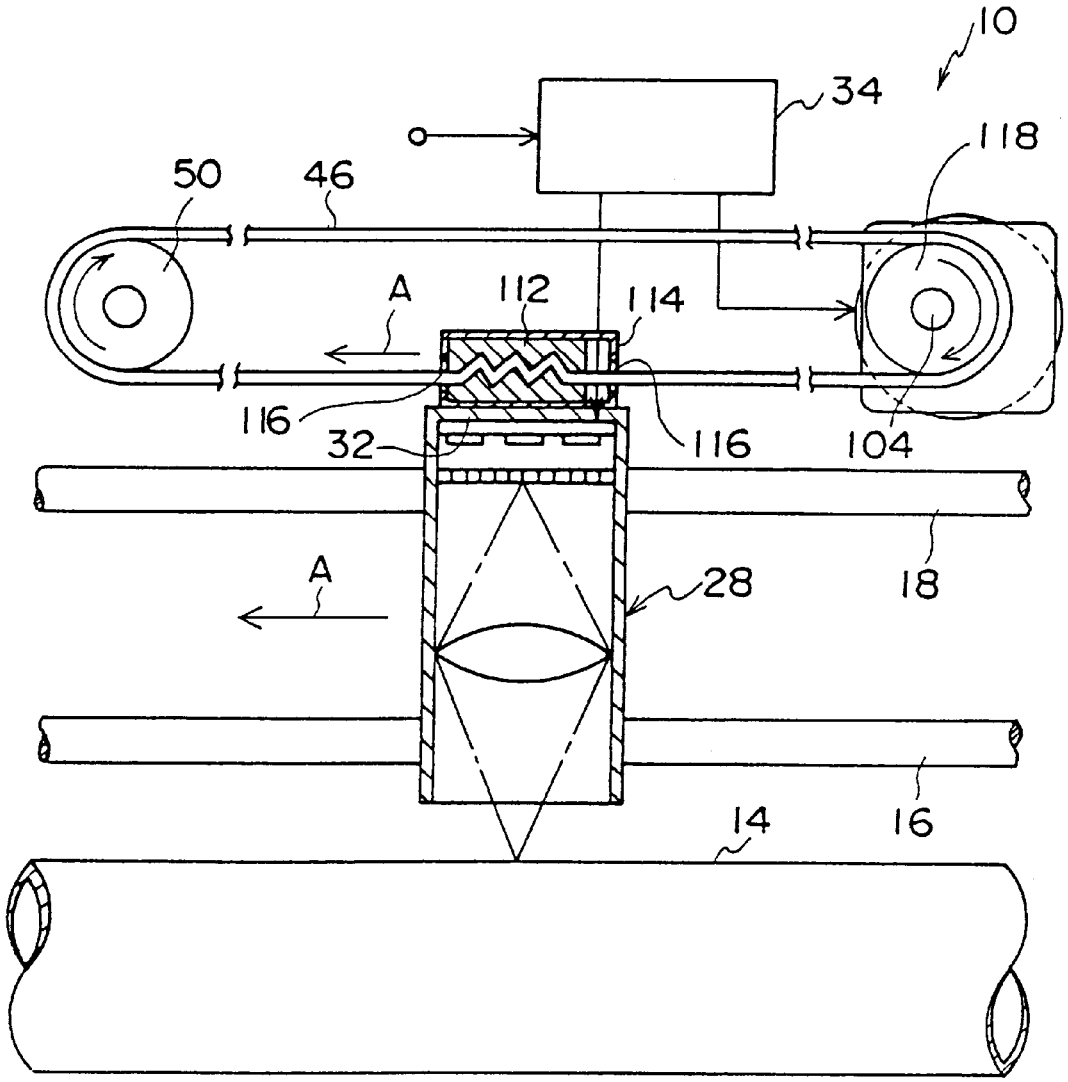
FIG. 10 is a front view illustrating a state of a driving mechanism for a scanning head according to a third embodiment of the present invention during forward scanning.
Figure 11:
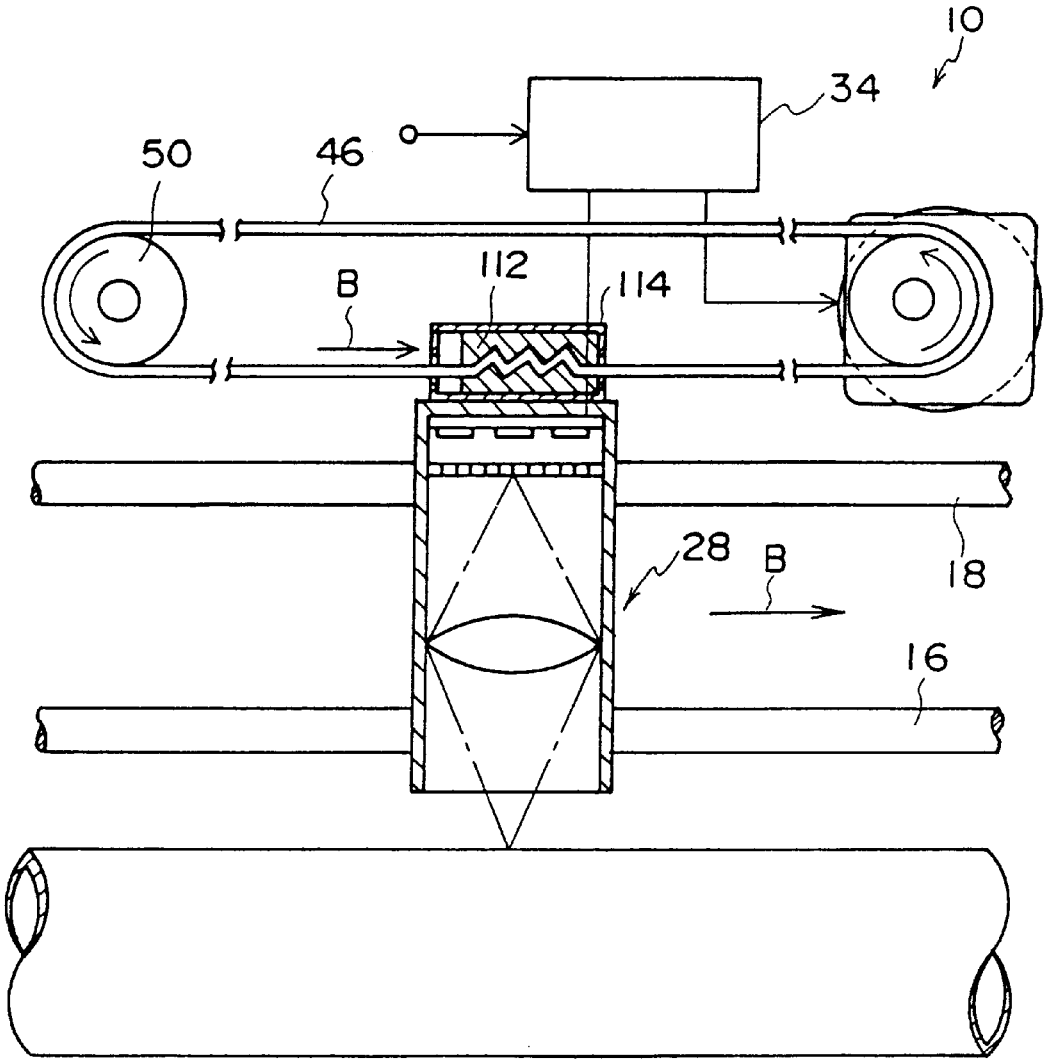
FIG. 11 is a front view illustrating a state of the driving mechanism for a scanning head according to the third embodiment of the present invention during backward scanning.

The third embodiment of the present invention differs from the second embodiment of the present invention in that, in the third embodiment, as is shown in FIGS. 10 and 11, the play mechanism is provided at the points at which driving force is transmitted to the scanning head 28, and an ordinary sprocket 118 is mounted to the driving shaft 104.

Namely, in the third embodiment, a slider 112 which is fixed to the timing belt 46 is slidably accommodated in a holder 114 which is mounted to the bottom plate 32 of the scanning head 28. Further, the timing belt 46 passes through slits 116 formed at both end portions of the holder 114.

In such a structure as described above, as is shown in FIG. 10, when the sprocket 118 rotates in a clockwise direction and the timing belt 46 is moving in the direction of arrow A (forward scanning), the slider 112 abuts the left-hand side wall of the holder 114 and causes the scanning head 28 to scan in the direction of arrow A.

When the scanning head 28 which has scanned in the forward direction stops and the stepping motor 52 is rotated reversely, as is shown in FIG. 11, the slider 112 moves idly by a predetermined stroke until it abuts the right-hand side wall of the holder 114.

This slider 112 provides a stroke which corresponds to a phase within a range from ¼ to ¾ of a rotational period of the driving force transmitting system of the scanning head 28. As a result, in the same manner as in the second embodiment of the present invention, since phases between amplitudes and periods of vibration of the driving force transmitting system do not correspond to each other in each of the forward scanning and the backward scanning, density unevenness is prevented from concentrating at a given position, and visibility of vertical stripes thereby decreases.

Next, a driving mechanism for a scanning head relating to a fourth embodiment will be described.

Figure 13A:
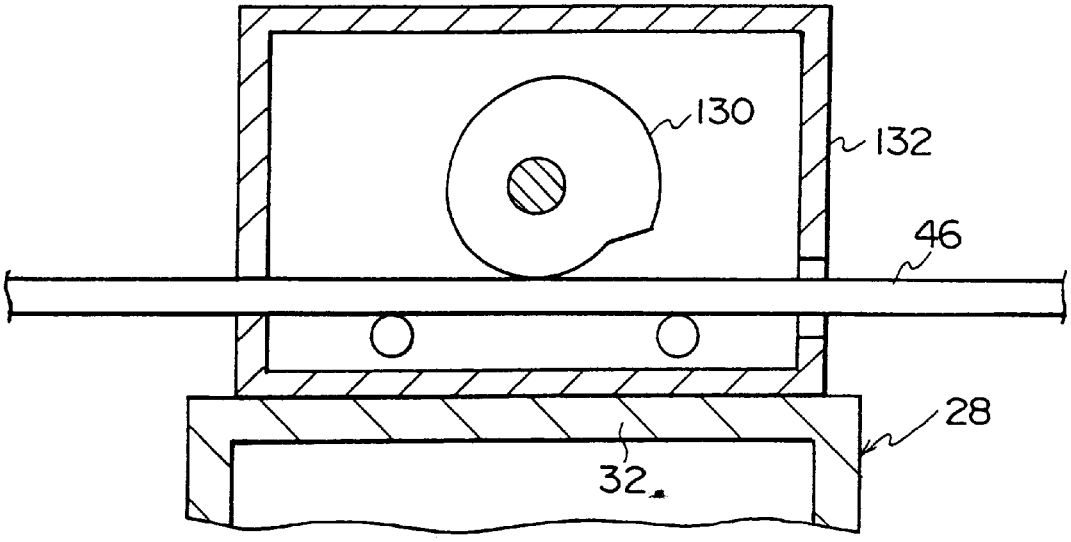
FIG. 13A is a front view illustrating a state of a driving mechanism for a scanning head relating to a fourth embodiment of the present invention during forward scanning.
Figure 13B:
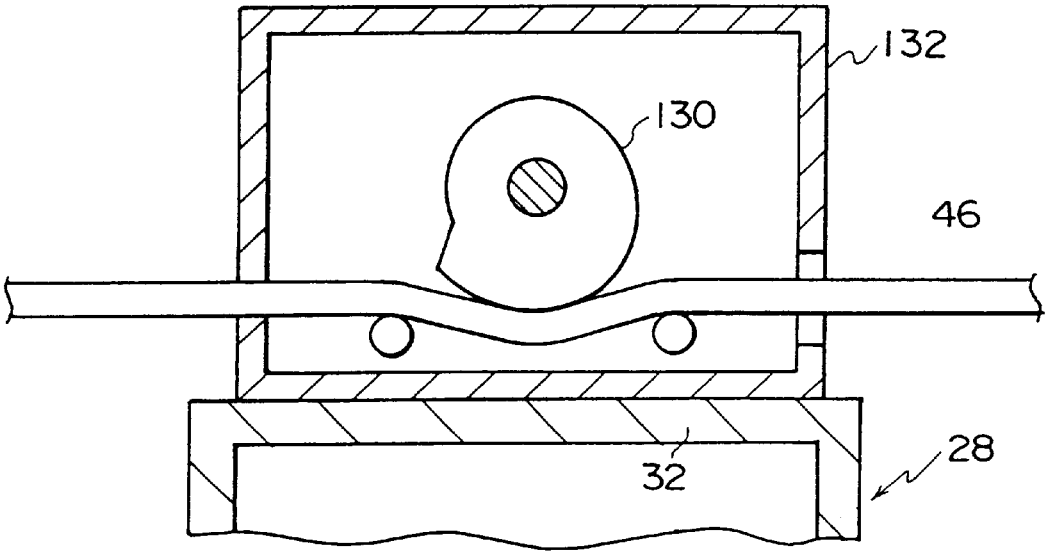
FIG. 13B is a front view illustrating a state of the driving mechanism for the scanning head relating to the fourth embodiment of the present invention during backward scanning.
Figure 14:
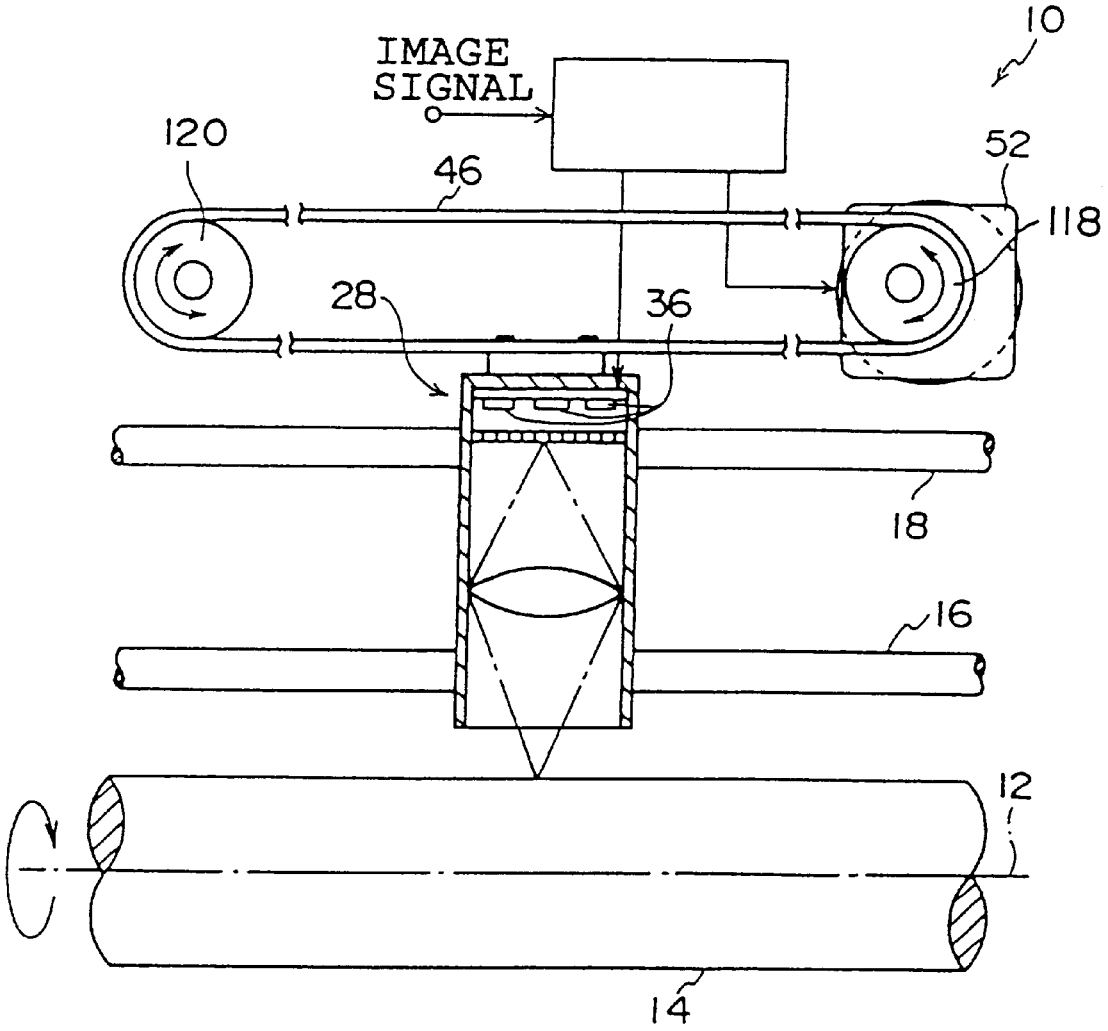
FIG. 14 PRIOR ART
FIG. 14 is a front view illustrating a driving mechanism of a conventional scanning head.
Figure 15:
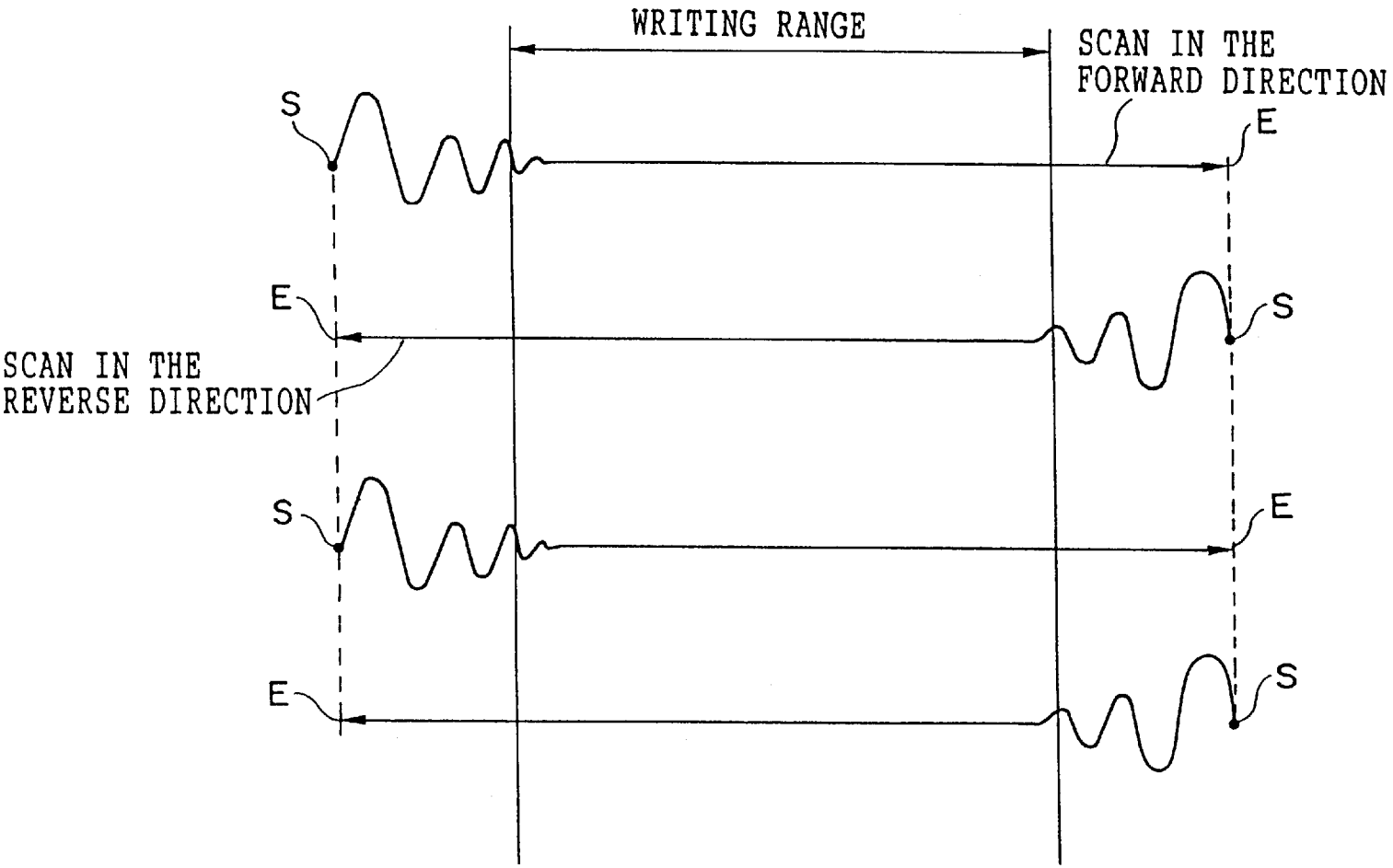
FIG. 15 is a graph which shows vibration waveforms when a conventional scanning head scans reciprocatingly.

As illustrated in FIGS. 13A and 13B, one end of the timing belt 46 is fixed to a holder 132 which is mounted to the bottom plate 32 of the scanning head 28. A cam 130 is provided in the holder 132. A motor (not shown) is rotated, the timing belt 46 is pushed downward, and the tension of the timing belt 46 is changed per scan.

In this way, even in a case in which scanning is carried out in only one direction, the phase of the amplitude and period of the vibration is varied per scan, so that there is no concentration of unevenness in density, and vertical stripes are less visible.

In the above description, cases in which the scanning head writes an image onto a photosensitive material or the like have been explained. However, the scanning head of the present invention can of course be used for a scanner for reading images.

What is claimed is:

1. A driving mechanism for a scanning head which travels and effects one of reading an image and writing an image, comprising a mechanism which creates a difference between at least one of periods of and phases of vibration caused by a scanning and driving system, in each scan for one of reading an image and writing an image, said driving mechanism further comprising:

an acceleration pattern which generates vibrations at the scanning head at an arbitrary position during acceleration of the scanning head, in each scan for one of reading an image and writing an image; and a mechanism for changing the acceleration pattern, which changes the position at which vibrations are generated.

2. A driving mechanism for a scanning head which travels and effects one of reading an image and writing an image, comprising a mechanism which creates a difference between at least one of periods of and phases of vibration caused by a scanning and driving system, in each scan for one of reading an image and writing an image, said driving mechanism further comprising:

a drive control mechanism which changes one of a driving starting position and an acceleration starting position of the scanning head in one of outside an image reading range and outside an image writing range, wherein the one of the driving starting position and the acceleration starting position of the scanning head is inputted in advance on the basis of data regarding vibration periods during driving of the scanning head.

3. A driving mechanism for a scanning head according to claim 2, wherein the drive control mechanism changes a stopping position of the scanning head, and starts driving of the scanning head from the stopping position.

4. A driving mechanism for a scanning head according to claim 2, wherein the drive control mechanism changes a stopping position of the scanning head, and starts driving of the scanning head from the stopping position.

5. A driving mechanism for a scanning head according to claim 2, wherein in each scan for one of reading an image and writing an image, fine driving is superposed on a driving pulse of a pulse motor which drives the scanning head.

6. A driving mechanism for a scanning head which travels and effects one of reading an image and writing an image, comprising a mechanism which creates a difference between at least one of periods of and phases of vibration caused by a scanning and driving system, in each scan for one of reading an image and writing an image, said driving mechanism further comprising:

a drive control mechanism which changes one of a driving starting position and an acceleration starting position of the scanning head in one of outside an image reading range and outside an image writing range, wherein data on vibration periods during driving of the scanning head is measured, and on the basis of the measured data, the one of the driving starting position and the acceleration starting position of the scanning head is calculated, and the calculated one of the driving starting position and the acceleration starting position of the scanning head is inputted.

7. A driving mechanism for a scanning head according to claim 6, wherein the drive control mechanism changes a stopping position of the scanning head, and starts driving of the scanning head from the stopping position.

8. A driving mechanism for a scanning head according to claim 6, wherein in each scan for one of reading an image and writing an image, fine driving is superposed on a driving pulse of a pulse motor which drives the scanning head.

9. A driving mechanism for a scanning head which travels and effects one of reading an image and writing an image, comprising a mechanism which creates a difference between at least one of periods of and phases of vibration caused by a scanning and driving system, in each scan for one of reading an image and writing an image, said driving mechanism further comprising:

a drive control mechanism which changes one of a driving starting position and an acceleration starting position of the scanning head in one of outside an image reading range and outside an image writing range, wherein in each scan for one of reading an image and writing an image, fine driving is superposed on a driving pulse of a pulse motor which drives the scanning head.

10. An image recording device, comprising:

a photosensitive material accommodating portion;

a photosensitive material pull-out device which pulls out a photosensitive material accommodated in said photosensitive material accommodating portion;

an exposure drum around which said photosensitive material, which has been pulled out by said photosensitive material pull-out device, is trained;

a scanning head which moves reciprocatingly in a direction intersecting a conveying direction of said photosensitive material so as to scan and expose said photosensitive material which has been trained around said exposure drum;

an image receiving material accommodating portion;

an image receiving material pull-out device which pulls out an image receiving material which has been accommodated in said image receiving material accommodating portion;

a heat drum around which said image receiving material pulled out by said image receiving material pull-out device and said photosensitive material exposed by said scanning head are trained, conveyed and heated in a state of being overlapped with each other, such that said photosensitive material is heat-developed and an image is transferred onto said image receiving material;

a photosensitive material peeling device which peels the heat-developed photosensitive material off from the image receiving material onto which the image has been transferred;

a take-up and accommodating device which takes up and accommodates the photosensitive material which has been peeled by said photosensitive material peeling device; and an image receiving material accommodating portion which accommodates therein the image receiving material onto which the image has been transferred and which has been peeled off from the photosensitive material, wherein a driving mechanism for driving said scanning head has a function of creating a difference between at least one of periods of and phases of vibration caused by a scanning and driving system, in each scan for one of reading an image and writing an image.

11. An image recording device, comprising:

a photosensitive material accommodating portion;

a photosensitive material pull-out device which pulls out a photosensitive material accommodated in said photosensitive material accommodating portion;

an exposure drum around which said photosensitive material, which has been pulled out by said photosensitive material pull-out device, is trained;

a scanning head which moves reciprocatingly in a direction intersecting a conveying direction of said photosensitive material so as to scan and expose said photosensitive material which has been trained around said exposure drum;

an image receiving material accommodating portion;

an image receiving material pull-out device which pulls out an image receiving material which has been accommodated in said image receiving material accommodating portion;

a heat drum around which said image receiving material pulled out by said image receiving material pull-out device and said photosensitive material exposed by said scanning head are trained, conveyed and heated in a state of being overlapped with each other, such that said photosensitive material is heat-developed and an image is transferred onto said image receiving material;

a photosensitive material peeling device which peels the heat-developed photosensitive material off from the image receiving material onto which the image has been transferred;

a take-up and accommodating device which takes up and accommodates the photosensitive material which has been peeled by said photosensitive material peeling device; and an image receiving material accommodating portion which accommodates therein the image receiving material onto which the image has been transferred and which has been peeled off from the photosensitive material, wherein a driving mechanism for driving said scanning head has a drive force transmitting mechanism which has a mechanism that creates a difference between at least one of phases of and periods of vibration caused by a scanning and driving system, in a forward scanning and a backward scanning of said scanning head.

* * * * *